US007845083B1

(12) United States Patent
Cora Rosa

(10) Patent No.: US 7,845,083 B1
(45) Date of Patent: Dec. 7, 2010

(54) STABILIZED T-SQUARE

(76) Inventor: Edgardo Cora Rosa, 29 Bennett Rd., Marblehead, MA (US) 01945

( * ) Notice: Subject to any disclaimer, the term of this patent is extended or adjusted under 35 U.S.C. 154(b) by 235 days.

(21) Appl. No.: 11/827,690

(22) Filed: Jul. 13, 2007

(51) Int. Cl.
*B43L 13/00* (2006.01)
*B26B 29/00* (2006.01)

(52) U.S. Cl. ..... 33/42; 33/479; 30/293

(58) Field of Classification Search ..... 33/42, 33/41.1, 479, 483–486, 474, 448, 403
See application file for complete search history.

(56) References Cited

U.S. PATENT DOCUMENTS 4,279,081 A * 7/1981 Wing et al. ..... 33/479
4,903,409 A * 2/1990 Kaplan et al. ..... 33/42
5,113,596 A 5/1992 Meyers
5,231,764 A * 8/1993 Chang ..... 30/293
5,471,753 A * 12/1995 Rodrigues ..... 33/42
D367,617 S * 3/1996 Wiegman ..... D10/65
5,720,082 A * 2/1998 Rossmo ..... 16/244
5,848,481 A 12/1998 Parsons et al.
6,070,331 A * 6/2000 Dempsey ..... 33/42
6,289,594 B1 * 9/2001 Wrobbel ..... 33/42
6,467,174 B1 * 10/2002 Kotori ..... 30/293
6,612,035 B2 * 9/2003 Brown et al. ..... 30/292
6,629,370 B1 10/2003 Sposato
7,096,592 B2 * 8/2006 Truckner ..... 33/562
7,178,246 B2 * 2/2007 McCallum ..... 33/42
7,320,181 B2 * 1/2008 Charpentier ..... 33/407
2003/0051363 A1 * 3/2003 Hofmeister et al. ..... 33/613
2006/0156558 A1 * 7/2006 Owens ..... 33/42
2007/0277387 A1 * 12/2007 Morrell ..... 33/429

* cited by examiner

*Primary Examiner*—Yaritza Guadalupe-McCall
(74) *Attorney, Agent, or Firm*—David J. Wilson

(57) ABSTRACT

The present invention relates to a device for easily and accurately marking, scoring and cutting drywall sheet material, the device having a general appearance of a T-square and comprising gripping pins for securely holding the T-square on the sheet material to be marked, scored or cut.

17 Claims, 4 Drawing Sheets

STABILIZED T-SQUARE

BACKGROUND OF INVENTION

Drywall is used in the construction of buildings. It is plasterboard made of gypsum and other ingredients and is sold in sheets of, typically, 4 feet by 8 feet. It is used for covering wall studs and is then covered with, for example, paint or wallpaper. Drywall needs to be sized to be used for most applications. Although drywall is easy to cut by scoring the drywall and then "snapping" the drywall at the score mark, it is often cumbersome to make properly measured straight score marks and breaks. Furthermore, the tools often used to facilitate this work typically slide around when being used. This is because the tools used to permit the scoring and cutting of an eight-foot piece of drywall must be long and, as the user scores the dry wall, it can be difficult to also hold the alignment tool in place. Manual techniques are cumbersome and require stretching and reaching by the user. If the alignment tool moves at all, inaccurate score marks are made and this leads to mistakes and wastes time and materials.

Today, drywall is typically cut with a straight edge and a utility knife. Sometimes people use T-squares or other devices as an alignment tool to help ensure that the score marks and breaks are straight. Others have designed devices to aid users in the scoring and cutting of drywall but these prior art solutions to this problem are not without significant problems of their own.

For example, U.S. Pat. No. 6,467,174 to Kotori (issued Oct. 22, 2002) discloses a drywall T-square with a slidable marker/cutter carrier that mounts on the long arm of the T-square. To use the device the T-square must me moved along the top of the drywall sheet. The cuts made by this device are perpendicular to the axis of the long arm of the T-square. This device does not disclose any means to ensure that the T-square does to move when being used.

U.S. Pat. No. 6,629,370 to Sposato, (issued Oct. 7, 2003) also discloses a drywall cutter T-square with a slidable marker/cutter carrier that mounts on the long arm of the T-square. To use the device the T-square must me moved along the top of the drywall sheet. The cuts made by this device are perpendicular to the axis of the long arm of the T-square. This device does not disclose any means to ensure that the T-square does to move when being used.

U.S. Pat. No. 6,070,331 to Dempsey (issued Jun. 6, 2000) discloses a T-square with tabs that work to keep the device from rocking as it is being used. Although this device may aid in preventing the T-square from rocking frontward and backward out of the plane of the drywall sheet, it does not prevent the long arm of the T-square from moving in an arc across the front of the drywall sheet.

U.S. Pat. No. 5,113,596 to Meyers (issued May 19, 1992) describes a T-square device for use with a conventional tape measure. Other than an edge that folds over the end of the sheet material, this device does not disclose any suitable means to ensure that the T-square does to move when being used. In other words, it only ensures that the device does not move in one plane (i.e., our of the plane of the sheet material).

U.S. Pat. No. 5,848,481 to Parsons, et at, (issued Dec. 15, 1998) describes a T-square device for use with a conventional tape measure. This device allows for the tilting of the tape measure on the T-square accessory. Other than an edge that folds over the end of the sheet material, this device does not disclose any suitable means to ensure that the T-square does to move when being used. In other words, it only ensures that the device does not move in one plane (i.e., our of the plane of the sheet material).

U.S. Pat. No. 4,903,409 to Kaplan, et al., (issued Feb. 27, 1990) discloses a T-square device for scribing and scoring drywall. The device has a slidable knife and slidable pencil holders. To use the device the T-square must me moved along the top of the drywall sheet. The cuts made by this device are perpendicular to the axis of the long arm of the T-square. This device does not disclose any means to ensure that the T-square does to move when being used.

Therefore, what is needed is a drywall cutter that solves these prior art problems. Namely, what is needed is a drywall cutter that has a means for ensuring that the drywall cutter T-square device does not rock side-to-side in an arc across the face of the drywall material.

SUMMARY OF INVENTION

In one aspect, the invention relates to a drywall cutter (also referred to herein as a "T-square device") that solves the problems identified with the prior art devices. In one embodiment, the T-square device of the present invention is not limited to scoring and cutting drywall. For example, the device of the present invention may be used to score and/or cut other materials such as cardboard, poster board, plywood, sheet metal, etc. In this regard, the blade and blade holder of the present invention is removable and replaceable with, for example, a pen holder or marker holder (for holding a pen, pencil, marker or other writing utensil) as well as a heavier blade or other device that is useful for marking, scoring and cutting sheet material. One of skill in the art will understand which of the implements would be useful for the particular task being performed. However, by way of non-limiting illustration, a pencil or other marker, for example, may be useful to mark a cutting line on wood, metal or paper. A blade may be useful to score drywall or cut paper, etc.

Although the device of the present invention may be used for marking, scoring and cutting sheet materials other than drywall, it is ideal for scoring and cutting drywall. Drywall, also commonly known as gypsum board, plasterboard (UK, Ireland, Australia), gibraltar board or gib (New Zealand—GIB being a trademark of Winstone Wallboards), rock lath, sheetrock (a trademark of United States Gypsum Company), gyprock (Canada and Australia—likely a portmanteau of "gypsum board" and "sheetrock") or rigips (Eastern Europe—after the Rigips brand), is a common manufactured building material used globally for the finish construction of interior walls and ceilings.

A drywall panel is made of a paper liner wrapped around an inner core made primarily from gypsum plaster, the semi-hydrous form of calcium sulphate ($CaSO_4 \cdot \frac{1}{2}H_2O$). The plaster is mixed with fiber (typically paper and/or fiberglass), foaming agent, various additives that increase mildew and fire resistance, and water and is then formed by sandwiching a core of wet gypsum between two sheets of heavy paper or fiberglass mats. When the core sets and is dried, the sandwich becomes rigid and strong enough for use as a building material.

The device of the present invention, in one embodiment, has the general appearance of a T-square and is referred herein as a T-square device. The T-square device of the present invention has several features to aid the user and solve the problems identified with the prior art devices discussed above. First, the T-square device of the present invention comprises two straight members, the first straight member and the second straight member. In one embodiment, the first straight member comprises, a scale engraved into or printed on the member. In another embodiment, the flat edge of the first straight member (i.e., the edge opposite the recess, may have markings or engravings on it such as, for example, measuring markings (e.g., standard or metric units) and/or other information that may be useful to one using the device (e.g., mathematical formulas, common conversion factors and/or firm logos).

In another embodiment, the first and/or second straight members of the present invention may comprise an extendable measuring device.

The second straight member of the T-square device of the present invention comprises, in one embodiment, a holder for a utility knife (or similar cutting device) or for holding a writing utensil. The holder may be capable of holding either of the two types of devices (i.e., cutting or writing) or a first holder may be interchangeable with a second holder, the first holder being capable of holding securely a cutting device and the second holder being capable of holding a writing device, for example. The present invention is not limited by the manner or mechanism by which the holder(s) of the present invention may be attached to the second straight member so long as the holders are capable of being moved along the length of the second straight member and thereby allow the cutting, scoring of or writing on the sheet material. Suitable holders are known in the art.

The second straight member of the present invention is fixedly attached to the first straight member to create a "T" shape for which the device is named. The second straight member of the device is attached to the first straight member at about mid way between the two ends of the first straight member. The second straight member is attached to the first straight member such that the second straight member and first straight member are perpendicular to each other. Thus, the T-square device of the present invention, when used to score and cut a piece of drywall, for example, is placed such that the first straight member rests on the edge of the drywall sheet material and with the second straight member resting on a flat side of the drywall sheet material.

In one embodiment, the second straight member of the T-square of the present invention comprises gripping pins that extend beyond the lower surface of the second straight member. The gripping pins of the present invention are designed to be pushed into the surface of the sheet material to be marked, scored or cut and thereby keep the T-square device of the present invention from shifting or moving across the face of the sheet material as the sheet material is being marker, scored or cut.

The present invention is not limited by the nature of the gripping pins used, their location on the second straight member or the number of pins present on the second straight member. For example, in one embodiment, the griping pins of the present invention are located in several clusters along the length of the second straight member. The present invention is not limited by the number of clusters of gripping pins. In one embodiment, the number of clusters of gripping pins numbers between about 1 and 10. In a preferred embodiment, the number of clusters number between 2 and 6. In a more preferred embodiment, the number of clusters number 3. In another embodiment, the gripping pins are not located in clusters but, rather, are spaced evenly or essentially along the length of the second straight member.

Likewise, there is no limit to the pins in any one cluster or spaced evenly along the second straight member. For example in one embodiment, each cluster of pins has between about 1 and 12 pins. In a preferred embodiment, the number of gripping pins per cluster numbers between 2 and 6. In a more preferred embodiment, the number of gripping pins per cluster numbers 2. In another embodiment, the number of pins on the second straight member, when the pins are evenly spaced (or essentially evenly spaced) number between about 1 and 10 or 12. In another embodiment, when the gripping pins of the present invention are evenly spaced along the length of the second straight member, they may be arranged in evenly spaced groups of pairs or triplets, etc., of gripping pins. In other words, the pairs, triplets, etc. of gripping pins would be evenly spaced along the length of the second straight member of the T-square device of the present invention.

The gripping pins of the present invention may be, in one embodiment, fixedly attached to the second straight member or, in another embodiment, they may be retractable or removable and repositionable into other holes located in the second straight member of the T-square device of the present invention. In this regard, in one embodiment, the gripping pins of the present invention are secured into pre drilled holes in the second straight member by a friction fit. To aid in generating a friction fit, the holes of the second straight member may have, in one embodiment, an insert of compressible material such as a plastic or rubber bushing (i.e., a friction bushing) that will hold the gripping pin securely when the gripping pin is inserted in to the hole. In this regard, the inserts may be replaceable in the event they not longer hold the gripping pin securely. For gripping pins that are repositionable, the gripping pins would extend beyond the top surface of the second straight member so that a user could grasp the gripping pin and thereby remove it with, for example, a pulling action. The gripping pin could then be placed in another hole by the user with a pushing action. In yet another embodiment, the gripping pin itself may comprise a snug fitting bushing (i.e., a friction bushing) of, for example, compressible material such as plastic or rubber, instead of or in addition to the compressible material of the holes designed to receive the gripping pins.

Furthermore, the length of the gripping pins of the present invention is not limited. In a preferred embodiment, the length of the portion of the gripping pins that extends into the sheet material is between about 1/16 and 1/2 inch. In preferred embodiment, the gripping pins extend into the sheet material between about 1/8 and 1/2 inch.

In another embodiment, the flat edge of the second straight member (i.e., the edge that can be viewed by the user when placed on a sheet of drywall or other sheet material, may have markings or engravings on it such as, for example, measuring markings (e.g., standard or metric units or other measurement marking such as distances between wall studs) or other information that may be useful to one using the device (e.g., mathematical formulas, common conversion factors and/or firm logos).

As mentioned above, the T-square device of the present invention also comprises a holding device for holding, for example, a blade or other sharp cutting instrument. The blade may be, but need not be, contained in a handle or blade handle. In the present specification, blade and blade handle may be used interchangeably and refer to a cutting device mounted on the blade holder of the present invention. In one embodiment, the holding device is attached to a slide that is positioned on the second straight member. In this regard, the second straight member may have a cutout portion designed for holding the blade or holder of the present invention. See, for example, FIGS. 1, 3 and 4. The holding device may be removable from the slide or integral with the slide. Other holding devices may be attached to the T-square device of the present invention by either attaching to the slide or by being placed such that it engages the cutout portion of the second straight member. Other holding devices may, for example, hold pencils, pens, markers (or other writing utensils) or other items that may be useful for the user of the T-square device of to the present invention. The other holding devices that hold a writing utensil holds the writing utensil, in one embodiment, at an angle of between 45 and 90 degrees (i.e., perpendicular) as measured from the surface of the sheet material.

The T-square device of the present invention is not limited by size. In one embodiment, the second straight member of the T-square device of the present invention is from about 12 inches to 8 feet long. In a preferred embodiment, the second straight member of the T-square device of the present invention is from about 24 inches to 48 inches long. The first length straight member of the T-square device of the present invention is not limited by the length of the second straight member of the present invention. In a preferred embodiment, the length of the first straight member is from about 25% to about 75% of the length of the second straight member of the present invention.

The width of the first and second straight members of the present invention is about 1 inch to 6 inches.

The present invention is not limited by the materials used to construct the device. In a preferred embodiment, the device comprises one or more of metal, plastic or wood.

In one embodiment of the present invention, the first straight member also comprises one or more tabs, stabilizers or stabilizing structures that help prevent the T-square of the present invention from rocking when being used. The stabilizers are located on the first straight member and are positioned to extend over the drywall or other sheet material and rest on the sheet material. In one embodiment, the stabilizers run the length of the first straight member, though they may be shorter. In another embodiment, the stabilizers extend about ½ inch to 2 inches over the sheet material.

The present invention also comprises a method of use wherein the T-square device of the present invention is positioned such that the rollers of the first straight member are resting on an edge of a sheet of drywall or other sheet material and the second straight member is resting on the flat surface of the sheet material. The blade holder (or other holder selected by the user) is then moved to the correct position on the second straight member by sliding the slide and attached holder along the second straight member until the correct position is achieved. In one embodiment, the holder and/or slide device may be secured in the desired position with, for example, a screw, wing nut of other device known in the art. The T-square device is then placed on the sheet material and pressure is exerted by the user to press the gripping pins into the sheet material. The holder is then mover along the second straight member the desired distance and causing a score or other mark to be made on the sheet material. In the case of drywall, after the drywall is scored with the T-square device of the present invention, the drywall may be "snapped" apart (by, for example, bending the drywall) at the location of the score mark.

Other features and advantages of the invention will be apparent from the following description.

DETAILED DESCRIPTION OF PREFERRED EMBODIMENTS

The invention will now be described in detail with reference to a few preferred embodiments, as illustrated in accompanying drawings. In the following description, numerous specific details are set forth in order to provide a thorough understanding of the invention. However, it will be apparent to one skilled in the art that the invention may be practiced without some or all of these specific details. In other instances, well-known features and/or process steps have not been described in detail in order to not unnecessarily obscure the invention. The features and advantages of the invention may be better understood with reference to the drawings and discussions that follow.

While the invention has been described with respect to a limited number of embodiments, those skilled in the art, having benefit of this disclosure, will appreciate that other embodiments can be devised which do not depart from the scope of the invention as disclosed herein.

Figure 1:
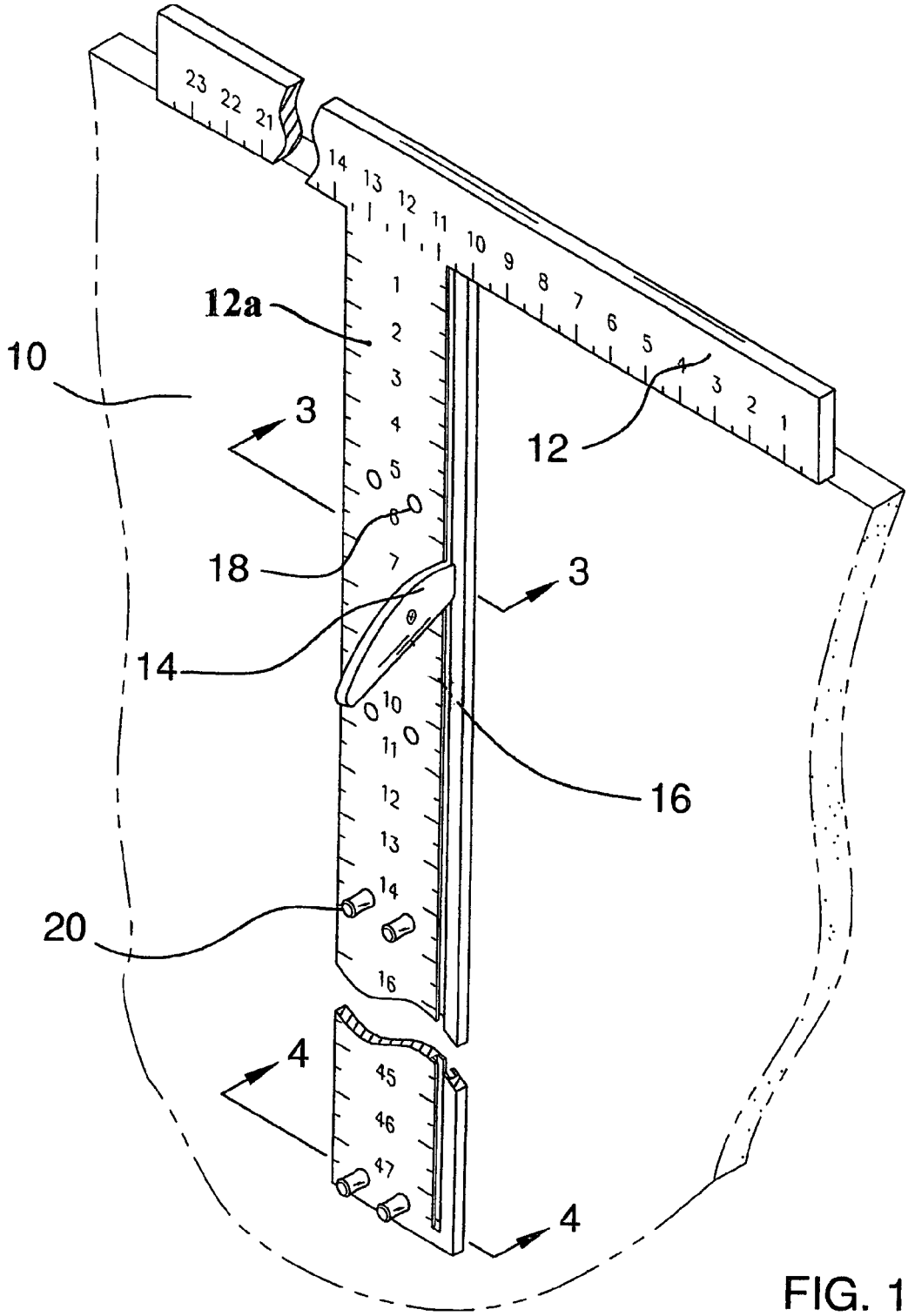
FIG. 1 shows one embodiment of a non-limiting view of the T-square device of the present invention.

Looking at FIG. 1, a piece of sheet material 10, (e.g., drywall) is positioned under the T-square device of the present invention. The first straight member 12 is positioned on the edge of the sheet material 10. The second straight member 12*a* is lying on the sheet material 10. The slide/blade 14 is positioned on the second straight member 12*a*. The track for the slide/holder is shown as 16. Gripping pin holes 18 are shown in the non-limiting configuration of three pairs (i.e., clusters) of two holes. Gripping pins 20 are shown inserted in four of the holes.

Figure 2:
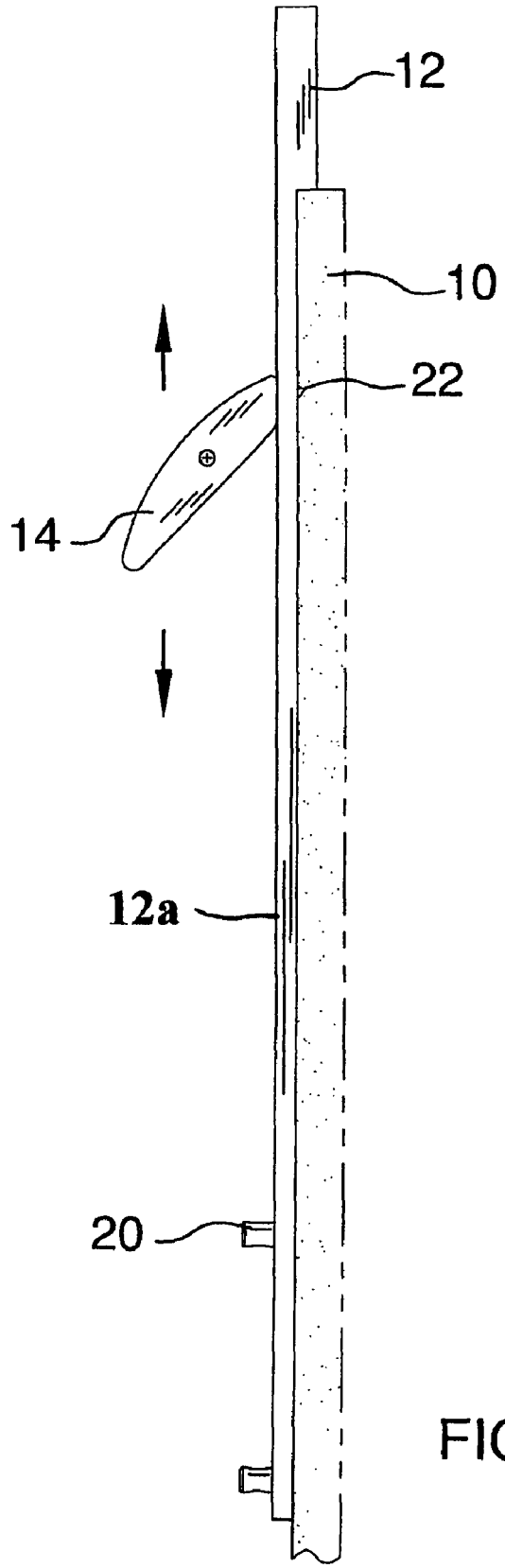
FIG. 2 shows one embodiment of a side view of lengthwise section of the second straight member of the present invention. In this non-limiting view, it can be seen how gripping pins of the present invention extend into the surface of the sheet material.

FIG. 2 shows a lengthwise section of the second straight member 12*a* at the location of the blade holding device. The second straight member 12*a* is resting on the drywall material 10. The slide/holder 14 is positioned on the second straight member 12*a* with the slide/holder engaged in the track of the second straight member 12*a*. Cutting blade 22 is shown. Gripping pins 20 are also shown.

Figure 3:
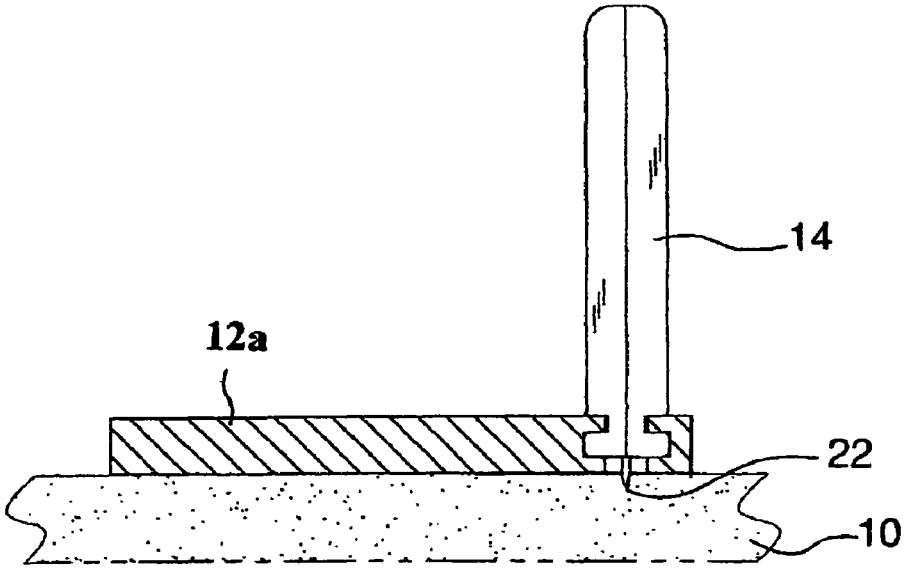
FIG. 3 shows one embodiment of cross section of the second straight member of the present invention showing an example of the cutting device of the present invention.

FIG. 3 shows a cross section of the second straight member 12*a*. The second straight member 12*a* is resting on the drywall material 10. Blade holder 14 is mounted in the track slide (not numbered in this figure). Blade 22 is shown inserted into drywall material 10.

Figure 4:
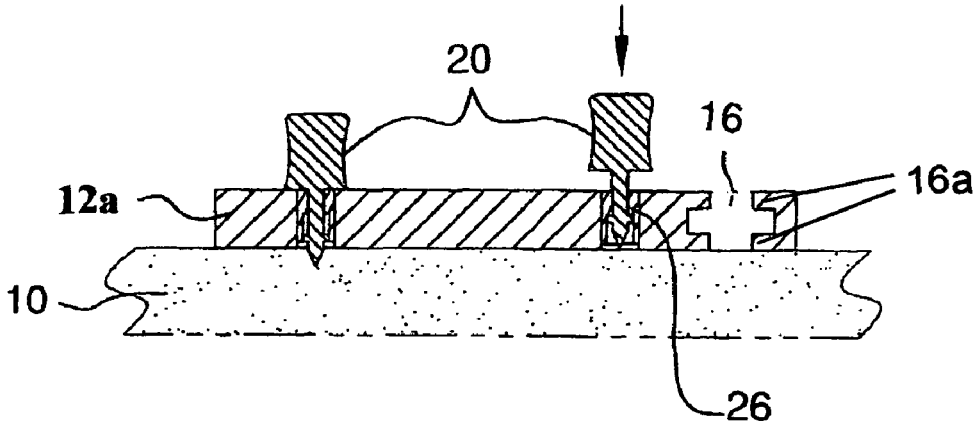
FIG. 4 shows an embodiment of how the gripping pins of the present invention may be raised so that they do not enter the surface of the sheet material.

FIG. 4 shows one embodiment of how the gripping pins of the present invention work. The second straight member 12*a* is shown in cross section. Non-removable gripping pins 20 are shown in a retracted and an inserted position. Friction bushings 26 are shown within the gripping pin holes. Track slide is shown 16.

Figure 5:
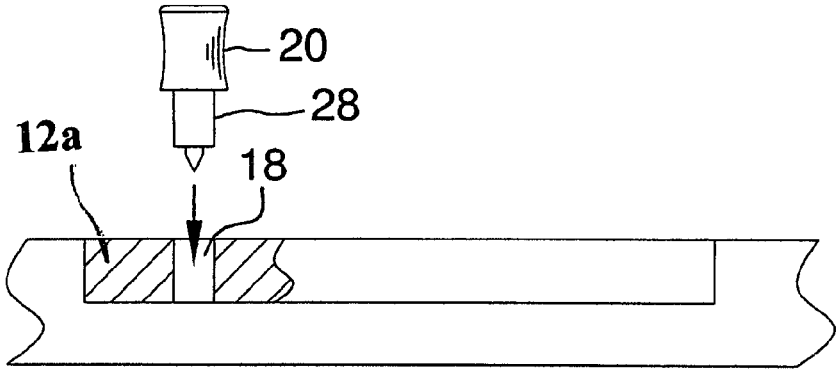
FIG. 5 shows one embodiment of a removable gripping pin of the present invention.

FIG. 5 shows another embodiment of how the gripping pins of the present invention work. The second straight member 12*a* is shown in cross section. One removable gripping pin 20 is shown in a retracted position taken out of gripping pin hole 18. Friction bushing 28 is shown on the gripping pin.

Figure 6:
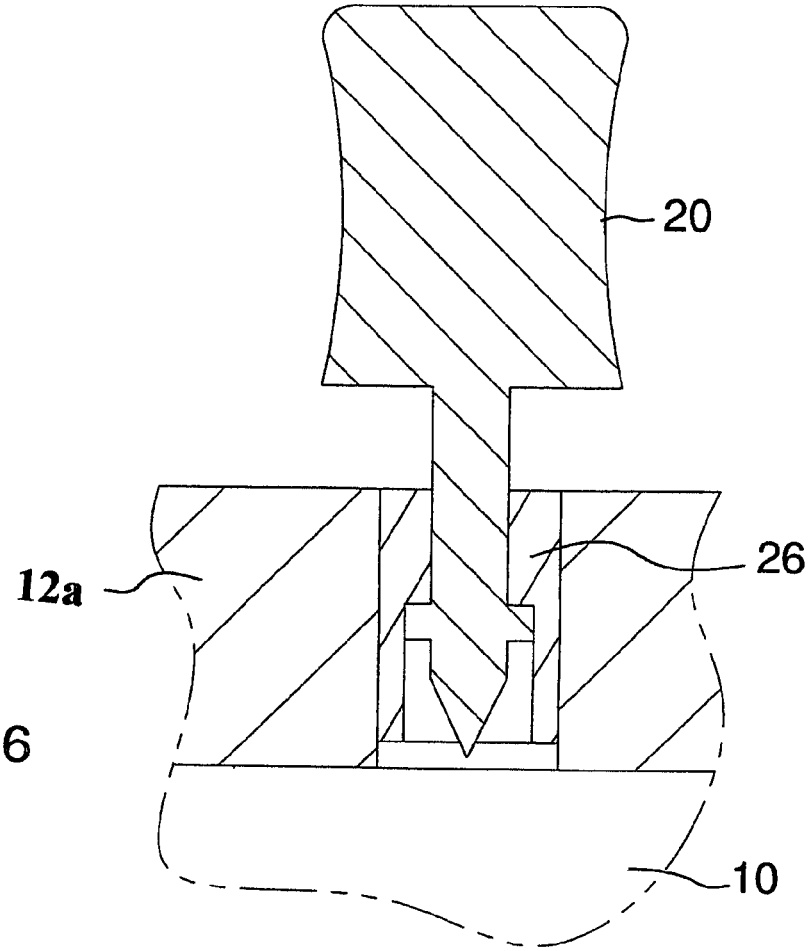
FIG. 6 shows one embodiment of the non-removable gripping pin of the present invention.

FIG. 6 shows one embodiment of non-removable gripping pin 20 in the retracted position in second straight member 12*a*. Friction bushing 26 is shown in the gripping pin hole.

What is claimed is:

1. A T-square device for aiding in the scoring and cutting of sheet material, consisting of:

a. a first straight member and a second straight member, said second straight member attached to the first straight member perpendicularly to the first straight member;

b. said second straight member having a top side and an underside, said second straight member having one or more gripping pins extending from the underside of said second straight member; and c. said T-square device, additionally comprising a device for cutting and scoring, said device comprising a blade, said blade removably attached to a blade holder and/or slide, said blade holder and/or slide having one or more tabs perpendicular to said blade that extend into a recess of said second straight member such that said blade holder and/or slide may slide essentially the length of said second straight member.

2. The T-square device of claim 1, wherein one or both of said first and second straight members comprises a measuring device or scale.

3. The T-square device of claim 1, wherein said gripping pins are removable.

4. The T-square device of claim 3, wherein said gripping pins comprise a friction bushing.

5. The T-square device of claim 1, wherein said gripping pins are retractable.

6. The T-square device of claim 5, wherein said the holes wherein said retractable gripping pins are located comprise a friction bushing.

7. The T-square device of claim 1, wherein said gripping pins are extendable out of the underside of said second straight member by about 1/16 to 1/2 inch.

8. The T-square device of claim 1, wherein said gripping pins extendable out of the underside of said second straight member by about 1/8 to 1/4 inch.

9. The T-square device of claim 1, wherein said gripping pins are positioned on said second straight member in one or more clusters of between 1 and 12 pins.

10. The T-square device of claim 9, wherein said clusters of gripping pins are evenly spaced the length of the second straight member.

11. The T-square member of claim 9, wherein said clusters number between 1 and 10.

12. The T-square member of claim 9, wherein said clusters number between 2 and 6.

13. The T-square device of claim 9, wherein said clusters of gripping pins evenly spaced the length of the second straight member.

14. The T-square device of claim 1, wherein said blade holder is replaced with a device for holding a writing utensil.

15. The T-square of claim 14, wherein said device for holding a writing utensil holds the writing utensil at an angle of between 45 and 90 degrees as measured from the surface of the sheet material.

16. A T-square device for aiding in the scoring and cutting of sheet material, consisting of:

a. a first straight member and a second straight member, said second straight member attached to the first straight member perpendicularly to the first straight member;

b. said second straight member having a top side and an underside, said second straight member having one or more gripping pins extending from the underside of said second straight member;

c. said T-square device, additionally comprising a device for cutting and scoring, said device comprising a blade, said blade removably attached to a blade holder and/or slide, said blade holder and/or slide having one or more tabs perpendicular to said blade that extend into a recess of said second straight member such that said blade holder and/or slide may slide essentially the length of said second straight member; and d. wherein said gripping pins are retractable and the holes in which said gripping pins are placed comprise friction bushings.

17. A T-square device for aiding in the scoring and cutting of sheet material, consisting of:

a. a first straight member and a second straight member, said second straight member attached to the first straight member perpendicularly to the first straight member;

b. said second straight member having a top side and an underside, said second straight member having one or more gripping pins extending from the underside of said second straight member;

c. said T-square device, additionally comprising a device for cutting and scoring, said device comprising a blade, said blade removably attached to a blade holder and/or slide, said blade holder and/or slide having one or more tabs perpendicular to said blade that extend into a recess of said second straight member such that said blade holder and/or slide may slide essentially the length of said second straight member; and d. wherein said gripping pins are removable and said gripping pins comprise friction bushings.

* * * * *